United States Patent [19]

Adam

[11] Patent Number: 4,944,857

[45] Date of Patent: Jul. 31, 1990

[54] MONOLITHIC FREQUENCY SELECTIVE LIMITER FABRICATION

[75] Inventor: John D. Adam, Murrysville, Pa.

[73] Assignee: Westinghouse Electric Corp., Pittsburgh, Pa.

[21] Appl. No.: 401,710

[22] Filed: Sep. 1, 1989

[51] Int. Cl.[5] ..... H01P 1/218

[52] U.S. Cl. ..... 204/192.15; 333/17.2; 427/123; 427/125; 427/126.1; 427/126.6

[58] Field of Search ..... 333/17.2; 427/123, 125, 427/126.1, 126.6; 204/192.15, 192.17, 192.2; 156/624

[56] References Cited

U.S. PATENT DOCUMENTS

| | | | |
|---|---|---|---|
| 4,005,375 | 1/1976 | Pringle et al. | 333/21 R |
| 4,044,357 | 8/1977 | Goldie | 343/17.5 |
| 4,155,053 | 5/1979 | Stitzer et al. | 333/17.2 |
| 4,243,697 | 1/1981 | Glass et al. | 427/47 |
| 4,251,786 | 2/1981 | Goldie et al. | 333/17.2 |
| 4,283,692 | 8/1981 | Adam | 333/17.2 |
| 4,325,140 | 4/1982 | Stitzer | 455/19 |
| 4,488,122 | 12/1984 | Wolkstein | 330/149 |
| 4,595,889 | 6/1986 | Stitzer et al. | 333/17.2 |
| 4,642,584 | 2/1987 | Funck et al. | 333/17.2 |
| 4,675,682 | 6/1987 | Adam et al. | 342/375 |
| 4,690,726 | 9/1987 | Luther et al. | 156/624 |
| 4,754,243 | 6/1988 | Armstrong et al. | 333/250 |
| 4,845,439 | 7/1989 | Stitzer et al. | 333/17.2 |

*Primary Examiner*—G. L. Kaplan
*Attorney, Agent, or Firm*—W. G. Sutcliff

[57] ABSTRACT

A plurality of frequency selective limiting (FSL) units are concurrently prepared on a common substrate by depositing a first ferrite member onto a metallized surface of the substrate. The first ferrite member is formed by sputtering a first ferrite film onto the metallized surface and subsequently growing a ferrite layer thereon. A plurality of signal carrying conductors are positioned in spaced relation on the first ferrite member. A second ferrite member is deposited on top in the same manner as the first ferrite member. The overall structure is diced into individual units that are then metallized thereby providing a plurality of FLS's.

18 Claims, 3 Drawing Sheets

MONOLITHIC FREQUENCY SELECTIVE LIMITER FABRICATION

BACKGROUND OF THE INVENTION

1. Field of the Invention

This invention relates to an attenuating element which utilizes a yttrium-iron-garnet (YIG) material, and more particularly to a method of fabricating a plurality of such elements at one time.

2. Description of the Related Art

Frequency selective limiters (FSL) are attenuating devices which utilize a yttrium-iron-garnet (YIG) material having the property of being able to attenuate higher power level signals while simultaneously allowing lower power level signals separated by only a small frequency offset from the higher level signals to pass with relatively low loss. YIG-based FSL's are capable of limiting or attenuating across more than an octave bandwidth in the 2–8 GHz range. Higher power level (above-threshold) signals within the device bandwidth will be attenuated without requiring tuning of the FSL. Lower power level (below-threshold) signals separated from the higher power level signals by more than a few spin wave line widths will pass through the FSL without experiencing any greater loss than if the higher power level signals were not present. For an attenuating device based on YIG, this selectivity bandwidth is on the order of between 20–50 MHz.

A portion of a fully assembled FSL 10 is illustrated in perspective in FIG. 1. Signal carrying conductor 12 is positioned between first and second YIG layers or slabs 14, 16. Both first and second YIG slabs 14 and 16 have a generally planar configuration, and the second YIG slab 16 has an overall length less than the overall length of the first YIG slab 14. As a result, the end portion 18 (one shown) of the signal carrying conductor 12 extends outwardly beyond the transverse edge 20 (one shown) of second YIG slab 16. The YIG slabs 14 and 16 and the signal carrying conductor 12 are supported on a metallized substrate 22 and are surrounded by a ground plane 24. Jumpers (not shown) may be utilized to serially connect a plurality of FSL's 10. The thickness of each YIG slab 14 and 16 may be varied to make the impedance of the signal carrying conductor 12 compatible with amplifiers and other external circuits (not shown). It has been found that increasing the thickness of the YIG slabs 14 and 16 increases the level of attenuation per unit length of YIG material at a given power level above some threshold power level. The apparatus shown in FIG. 1 is described in greater detail in a copending U.S. patent application entitled "Frequency Selective Limiting Device", Ser. No. 07/169,926, filed Mar. 18, 1988, now U.S. Pat. No. 4,845,439, in the name of Steven N. Stitzer et al. and assigned to Westinghouse Electric Corporation the assignee herein.

The processing technique used thus far for making individual FSL units 10 has consisted of cutting all of the parts of the structure to final size from standard wafers, then processing the individual parts through a series of steps. Individual parts processing is labor intensive and uniformity in the final product is difficult to achieve on a regular basis. In addition, the expense involved in individual parts processing can be considerable.

SUMMARY OF THE INVENTION

The present invention provides a method for assembling a plurality of frequency selective limiting (FSL) units. A first ferrite film is formed onto a metallized surface of a substrate layer. A ferrite layer is then grown on the first ferrite film. The film and layer form an integral first ferrite member. Subsequently, a plurality of signal carrying conductors are positioned on the first ferrite member in spaced relation. A second ferrite member is formed atop the signal carrying conductors in the same manner as the first ferrite member. The result is a monolithic multilayer structure which is then separated into a plurality of individual FSL units exposing the metallized surface. A layer of metal is deposited on free surfaces of the individual FSL units. The layer of metal forms a ground plane with the metallized surface of the substrate layer. The ground plane acts as an RF shield for containing the RF field lines generated by a signal flowing through the conductors to within the FSL unit.

DESCRIPTION OF THE PREFERRED EMBODIMENTS

The theory of operation and the construction of frequency selective limiting (FSL) devices which utilize a yttrium-iron-garnet (YIG) material are described in the following articles, which are incorporated by reference herein: "Frequency Selective Microwave Power Limiting in Thin YIG Films", *IEEE Transactions on Magnetics*, Vol. MAG-19, No. 5, September 1983, Steven N. Stitzer; "A Multi-Octave Frequency Selective Limiter", 1983 *IEEE MTT-S Digest*, page 326, Steven N Stitzer and Harry Goldie; "Non-Linear Microwave Signal-Processing Devices Using Thin Ferromagnetic Films", *Circuits Systems Signal Process*, Vol. 4, No. 1–2, 1985, page 227, Steven N. Stitzer and Peter R. Emtage.

The present invention comprises a method for fabricating a plurality of YIG-based FSL units or wafers at one time. Although the invention is described with YIG being the attenuating material, any suitable ferrite material may be used. Referring to FIGS. 2A–2I, only a fragmentary portion of a wafer is shown in cross section at each major step of the process. The process includes forming a monolithic multilayer wafer by applying layers of metal and YIG to a nonmagnetic substrate.

Figure 1:
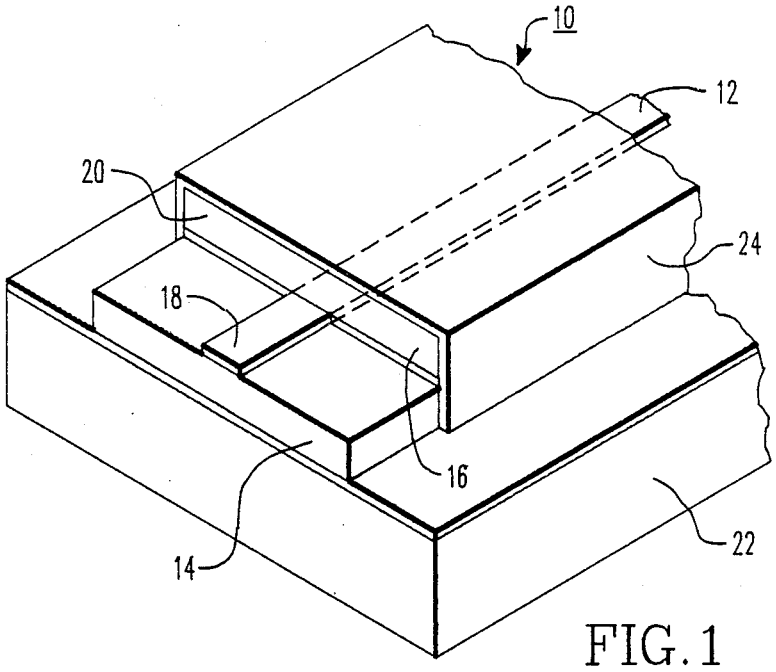
FIG. 1 is a perspective view of an FSL unit described in the above-referenced copending application.
Figure 2A:
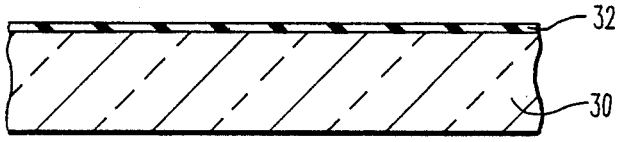
FIGS. 2A–2I present in a series of fragmentary side sectional views the sequence of steps for assembling a plurality of FSL units.

Referring to FIG. 2A, the first step of the process includes depositing a thin film of metal 32 on a nonmagnetic substrate 30. The nonmagnetic substrate which functions as a support for the overall FSL unit is preferably a commercially available gallium gadolinium garnet (GGG) wafer approximately 400 $\mu$m thick. The GGG material is desirable because of the similarity between its crystalline structure and that of YIG. In addition the GGG substrate can withstand exposure to the flux used in a later liquid phase epitaxy (LPE) step for depositing the YIG. The LPE deposition step is explained further below.

The metal film 32 forms a lower ground plane for the FSL unit. In the preferred embodiment the metal film 32 is made from platinum or iridium which can withstand the extreme temperatures associated with the LPE deposition step. Although more expensive, iridium is preferable to platinum because it has a higher melting point and lower resistivity. In practice, the selected metal is sputtered onto the GGG substrate 30 forming a film 32 approximately 2 μm thick. The sputtered film 32 conforms to the crystalline orientation of the GGG substrate 30.

Figure 2B:
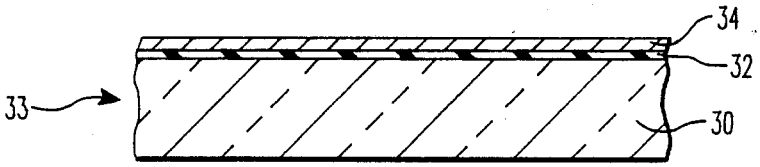

As shown in FIG. 2B, a thin (2 μm) film 34 of YIG is sputtered on to the metal film 32. The YIG 34 is crystallized by the application of heat supplied during the sputtering step by a substrate heater (not shown). Alternatively, the crystalline structure can be obtained by post-deposition annealing. The YIG film 32 acts as an adhesion layer for subsequent processing.

Figure 2C:
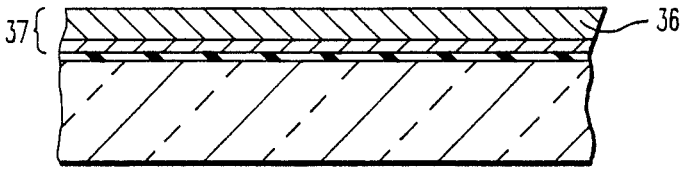

In FIG. 2C, a 100 μm thick YIG layer 36 is epitaxally grown on top of the sputtered YIG film 34. In the preferred embodiment, the YIG layer 36 is grown by a known liquid phase epitaxy (LPE) process that involves dissolving iron and yttrium oxides in a lead oxide plus boron oxide flux at a very high temperature. The solution is then cooled thereby becoming super saturated. The wafer 33, FIG. 2B, is dipped in the solution and the crystalline YIG layer 36, FIG. 2C, is formed on the YIG film 34 by nucleation. It is anticipated that the growth will not be a single crystal, and growth conditions will need to be adjusted to minimize flux inclusions. The result of the steps illustrated in FIGS. 2B and 2C is the formation of an integral YIG member 37. The sputtered YIG film 34 provides adhesion between the LPE grown YIG layer 36 and the metal film 32.

Figure 2D:
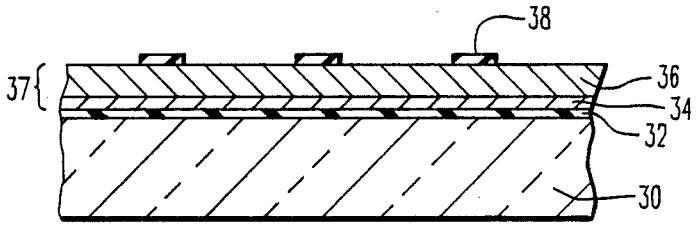
Figure 2E:
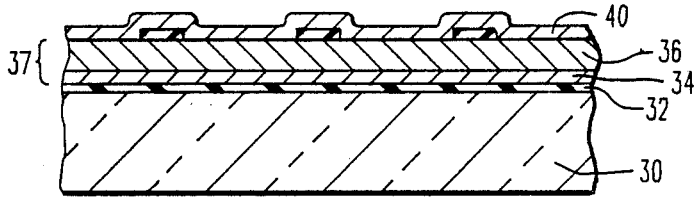
Figure 2F:
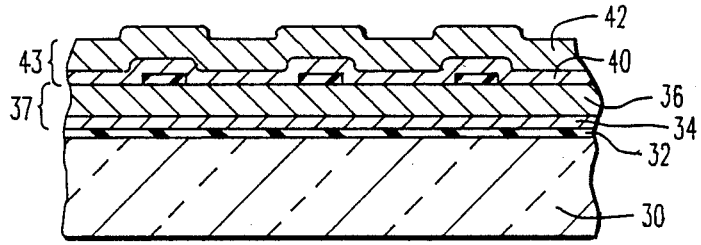

Referring to FIG. 2D, a plurality of signal carrying conductors 38, are deposited on the YIG member 37 by sputtering. Depending on the surface texture of the YIG member 37, a polishing step may be necessary to provide a smooth surface prior to deposition of the conductors 38. Preferably, the conductors 38 are platinum or iridium strips approximately 25 μm wide and at least 2 μm thick. Referring to FIGS. 2E and 2F, a second YIG member 43 is deposited on top of the conductors 38 and first YIG member 37. The second YIG member 43 is formed by the same two step process as the first YIG member 37. A YIG film 40 is sputtered onto the conductors 38 and first YIG member 37 in conformal manner (FIG. 2E). Subsequently, a YIG layer 42 is grown by LPE atop of the YIG film 40 (FIG. 2F) resulting in the integral YIG member 43.

Figure 2G:
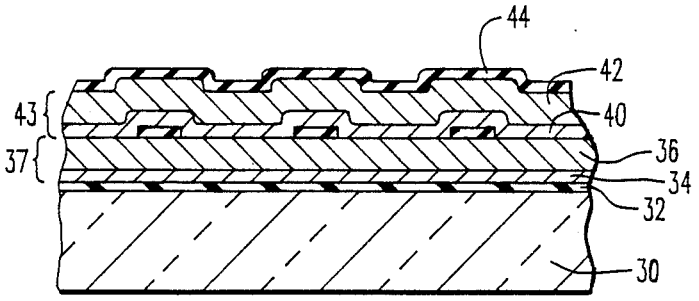

As illustrated in FIG. 2G, the upper surface of the YIG member 43 is metallized with gold or other low resistivity material such as copper or aluminum to a thickness of 5 μm. Standard evaporation and plating techniques can be used in depositing the film 44.

Figure 2H:
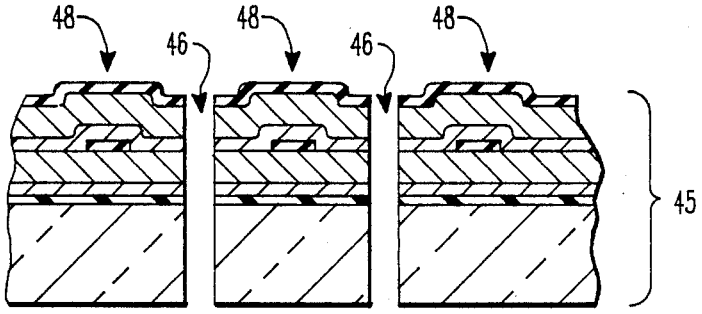

In FIG. 2H the overall multilayer structure 45 is diced between conductors 38 into individual sandwich structures 48. The metallized layer 34, which forms a lower ground plane, on the surface of the YIG layer 37 opposite the conductors 38 is exposed as shown.

Figure 2I:
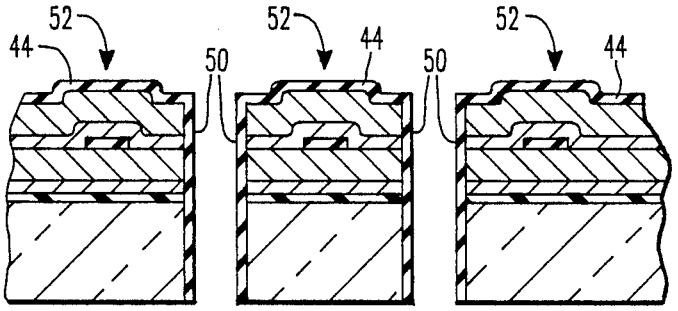

In FIG. 2I the structures 48 are metallized by deposition of a 5 μm thick gold film 50 or other low resistivity material, on the sides as shown to form individual FSL units 52. The film 50 which contacts the upper ground plane 44 and lower ground plane 34 completes the ground plane of the FSL's 52. Alternatively, the film 44 may be deposited concurrently after the dicing step with film 50. Each of the individual FSL units 52 are relatively uniform in physical and electrical characteristics.

Although the invention has been described in terms of what are at present believed to be its preferred embodiments, it will be apparent to those skilled in the art that various changes may be made without departing from the scope of the invention. It is therefore intended that the appended claims cover such changes.

I claim as my invention:

1. A method for assembling a frequency selective limiting unit having a multilayer structure, comprising the steps of:

depositing a first ferrite film on a metallized surface of a substrate layer;

growing a first ferrite layer on said first ferrite film;

positioning at least one signal carrying conductor on said first ferrite layer;

depositing a second ferrite film on said conductor and first ferrite layer in conformal manner;

growing a second ferrite layer on said second ferrite film to thereby form a monolithic multilayer structure; and depositing a layer of metal on a free surface of said monolithic multilayer structure in contact with the metallized surface of the substrate layer forming a ground plane.

2. A method for assembling a plurality of frequency selective limiting units having a multilayer structure, comprising the steps of:

depositing a first ferrite film on a metallized surface of a substrate layer;

growing a first ferrite layer on said first ferrite film;

positioning a plurality of signal carrying conductors in spaced relation on said first ferrite layer;

depositing a second ferrite film on said conductors and first ferrite layer in conformal manner;

growing a second ferrite layer on said second ferrite film, wherein said substrate layer, ferrite films and layers, and at least one conductor form a monolithic multilayer structure; and depositing a layer of metal on a free surface of said monolithic multilayer structure in contact with the metallized surface of the substrate layer forming a ground plane.

3. A method according to claim 2, wherein said first ferrite film is a relatively thin adhesion layer and said second ferrite layer is relatively thick.

4. A method according to claim 2, wherein said first and second ferrite layers are epitaxially grown.

5. A method according to claim 2, wherein said first and second ferrite layers are grown by liquid phase epitaxy.

6. A method according to claim 2, wherein said first and second ferrite films are deposited by sputtering.

7. A method according to claim 2, wherein the ferrite films and layers are formed of a yttrium iron garnet material.

8. A method according to claim 2, wherein the substrate layer is formed of a gallium gadolinium garnet material.

9. A method according to claim 2, wherein said at least one signal carrying conductor is sputtered on said first ferrite layer.

10. A method according to claim 2, wherein said at least one signal carrying conductor is formed of platinum.

11. A method according to claim 2, wherein said metallized surface is platinum.

12. A method according to claim 2, wherein said layer of metal is a material selected from a group consisting of platinum or gold.

13. A method according to claim 2, further comprising the step of cleaving said monolithic multilayer structure into a plurality of individual sandwich structures, each having a conductor.

14. A method according to claim 13, including the step of depositing a film of metal on a free surface of said second ferrite layer before said multilayer structure is cleaved into a plurality of individual sandwich structures.

15. A method according to claim 14, wherein said layer of metal, said film of metal, and said metallized surface of said substrate layer form a ground plane for containing RF field lines generated by a signal flowing through said conductor.

16. A method according to claim 13, wherein said layer of metal is deposited on a free surface of said second ferrite layer and along the cleaved surfaces of said multilayer structure.

17. A method according to claim 2, wherein said layer of metal and said metallized surface of said substrate layer form a ground plane for containing RF field lines generated by a signal flowing through said conductor.

18. A method according to claim 2, wherein said layer of metal is deposited by evaporation and plating.

* * * * *